US006305254B1

(12) United States Patent
Hsieh

(10) Patent No.: US 6,305,254 B1
(45) Date of Patent: Oct. 23, 2001

(54) COMBINATION TOOL KIT

(76) Inventor: Chih-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/634,577

(22) Filed: Aug. 8, 2000

(51) Int. Cl.[7] ..... B25F 1/00

(52) U.S. Cl. ..... 81/437; 81/177.4; 81/490; 81/124.5

(58) Field of Search ..... 81/124.5, 177.4, 81/437, 490

(56) References Cited

U.S. PATENT DOCUMENTS 5,313,860 * 5/1994 Liou ..... 81/437
5,927,162 * 7/1999 Huang ..... 81/177.4 X
6,112,351 * 9/2000 Hawkins et al. ..... 81/437 X
6,196,093 * 3/2001 Hu ..... 81/177.4 X

* cited by examiner

*Primary Examiner*—James G. Smith
(74) *Attorney, Agent, or Firm*—Varndell & Varndell, PLLC

(57) ABSTRACT

A combination tool kit includes an elongated casing, a hexagon head socket holder mounted in the casing between front and rear ends of the casing and holding a set of hexagon head sockets adapted for turning bolts and nuts, a combination wrench pivoted to the front end of casing, the combination wrench having an open end and a box end at two distal ends thereof adapted for grasping and turning bolts and nuts, and a hexagonal spanner block pivoted to the rear end of casing, the hexagonal spanner block having a hexagonal box adapted to work with one of the hexagon head sockets stored in the hexagon head socket holder for turning bolts and nuts.

5 Claims, 7 Drawing Sheets

COMBINATION TOOL KIT

BACKGROUND AND SUMMARY OF THE INVENTION

The present invention relates to hand tools, and more particularly to a handy, space-saving, practical combination tool kit of high industrial value.

A variety of hand tools are commercially available for grasping and turning bolts, nuts, etc. According to conventional designs, different wrenches, socket wrenches, ratchet socket wrenches, or reversible ratchet socket wrenches may be used for turning different sizes of bolts and nuts. Further, for turning bolts and nuts of different sizes, a socket wrench must be used of a full set of hexagon head sockets. When carrying socket wrench and a fill set of hexagon head sockets, a special tool box or the like must be used. It is expensive to prepare a special toolbox, different hand tools and tool accessories.

According to one aspect of the present invention, the combination tool kit comprises an elongated casing that works as a tool handle, a hexagon head socket holder mounted in the casing between front and rear ends of the casing and holding a set of hexagon head sockets adapted for turning bolts and nuts, a combination wrench pivoted to the front end of casing, the combination wrench having an open end and a box end at two distal ends thereof adapted for grasping and turning bolts and nuts, and a hexagonal spanner block pivoted to the rear end of casing, the hexagonal spanner block having a hexagonal box adapted to work with one of the hexagon head sockets stored in the hexagon head socket holder for turning bolts and nuts. According to another aspect of the present invention, the hexagonal spanner block is equipped with a ratchet assembly for working with the casing as a reversible ratchet socket wrench.

DETAILED DESCRIPTION OF THE PREFERRED EMBODIMENT

Figure 1:
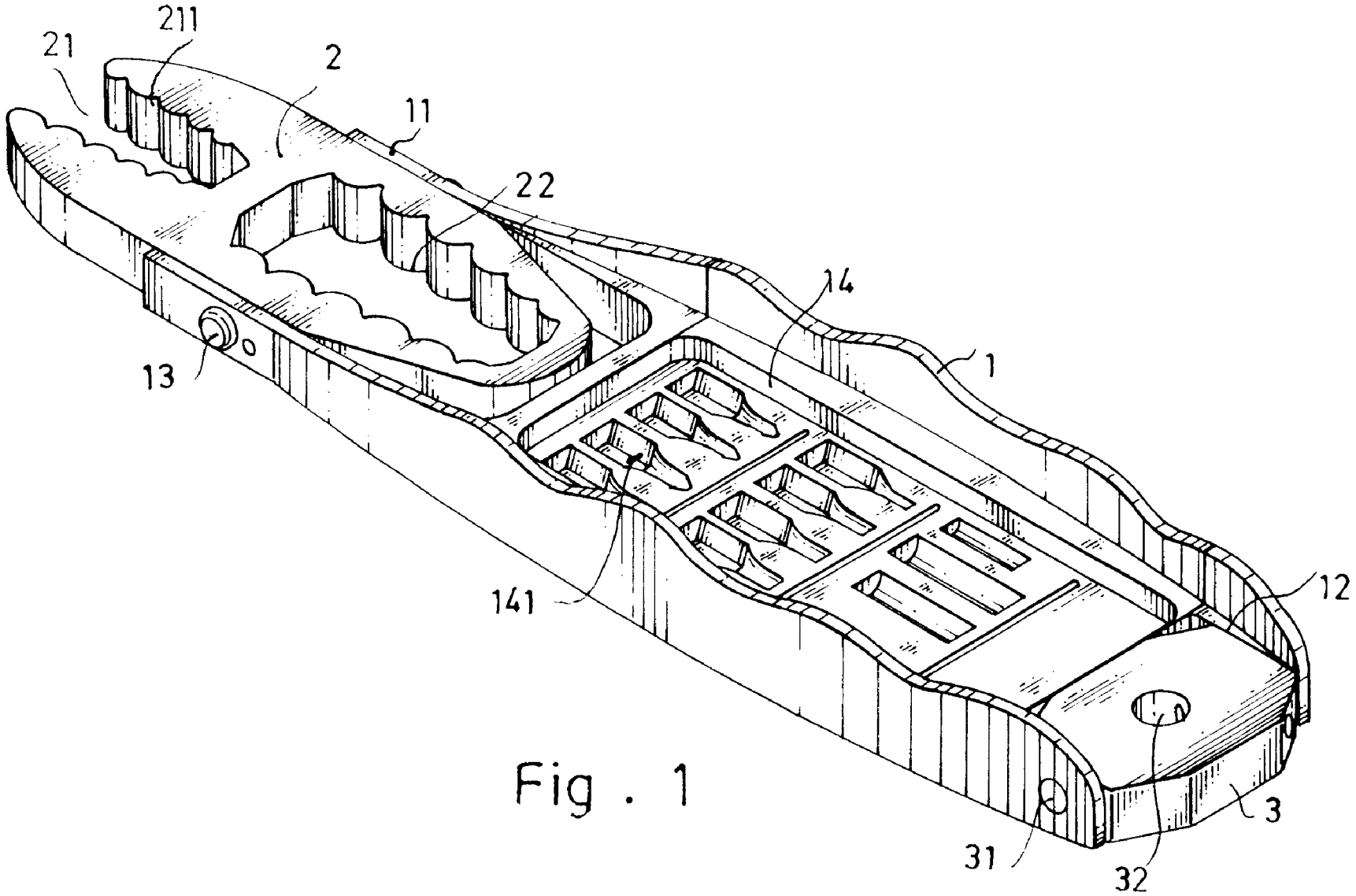
FIG. 1 is a perspective view of a combination tool kit according to one embodiment of the present invention.
Figure 3:
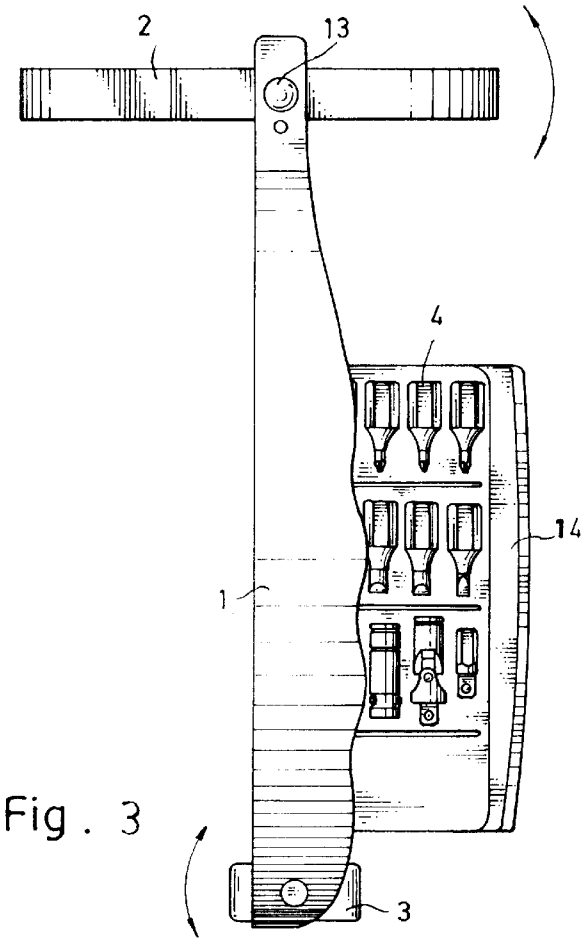
FIG. 3 shows the combination wrench, the hexagonal spanner block and the hexagon head socket holder respectively turned relative to the casing according to the present invention.
Figure 2:
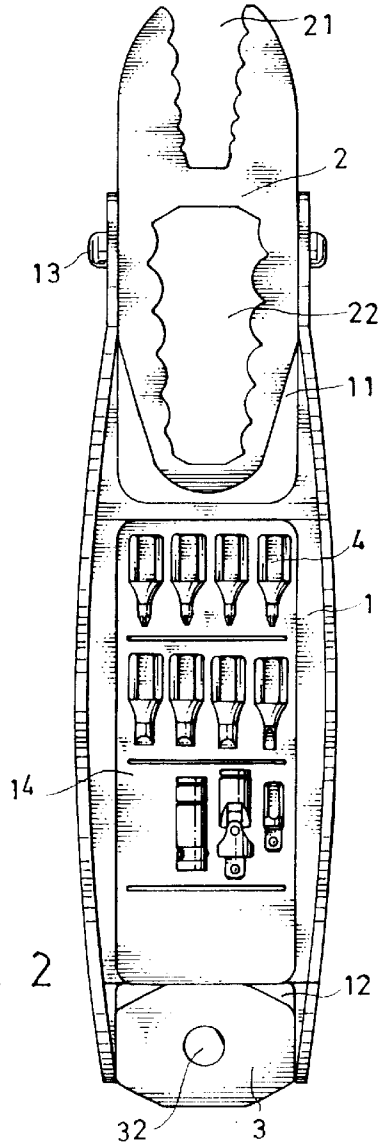
FIG. 2 is a top view of the combination tool kit shown in FIG. 1.
Figure 5:
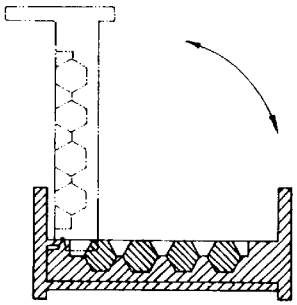
FIG. 5 is a sectional view taken along line 5—5 of FIG. 4 showing the hexagon head socket holder turned between a horizontal position and a vertical position.
Figure 4:
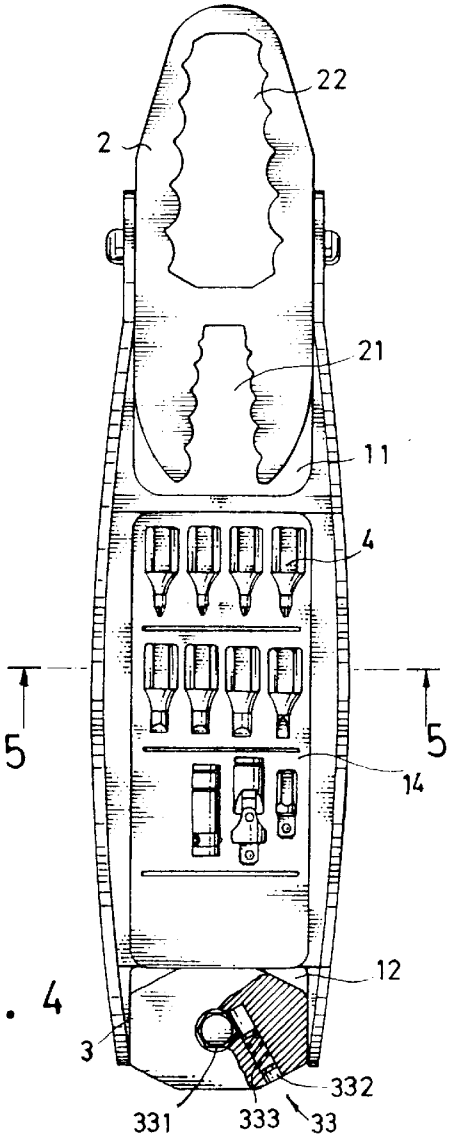
FIG. 4 is a cutaway view of FIG. 2, showing the positioning of the ratchet assembly in the hexagonal spanner block.

Referring to FIGS. from 1 through 4, a combination tool kit in accordance with the present invention comprises a casing 1 of elongated shape, a combination wrench 2, and a hexagonal spanner block 3. The casing 1 has a front opening 11, a rear opening 12, an intermediate open chamber (not shown) spaced between the front opening 11 and the rear opening 12, and a hexagon head socket holder 14 mounted in the intermediate open chamber. The hexagon head socket holder 14 comprises a plurality of receiving grooves 141 at top and bottom sidewalls thereof adapted to hold a set of hexagon head sockets 4. The combination wrench 2 is pivoted to the front opening 11 of the casing 1 by a pivot 13, having an open end 21 and a box end 22 at two distal ends thereof The open end 21 is comprised of two tooted jaws 211 facing each other for grasping and turning bolts, nuts, etc. The box end 22 defines an egg-like box with points in it for grasping and turning bolts and nuts of different sizes. The hexagonal spanner block 3 is pivoted to the rear opening 12 of the casing 1 by a pivot 31, having a hexagonal box 32 adapted to work with one of the hexagon head sockets 4 for turning bolts and nuts. When assembled, the hexagonal spanner block 3 can be turned about the pivot 31 to the desired working angle relative to the casing 1, and the combination wrench 2 can be turned about the pivot 13 between a first position where the open end 21 is disposed outside the casing 1 for working (see FIG. 1), and a second position where the box end 22 is disposed outside the casing 1 for working (see FIG. 4). Further, the hexagon head socket holder 14 has one side hinged to one side wall of the casing 1 such that the hexagon head socket holder 14 can be turned between a horizontal position received in the intermediate open chamber of the casing 1 (see FIGS. 1,2 and 4), and a vertical position outside the casing 1 (see FIGS. 3 and 5).

Referring to FIGS. 1 and 4 again, an one-way ratchet assembly 33 is installed in the hexagonal spanner block 3 enabling the hexagonal spanner block 3 to work with the casing 1 as a reversible ratchet socket wrench. The one-way ratchet assembly 33 comprises a ratchet wheel 331 mounted in the hexagonal box 32 of the hexagonal spanner block 3, a spring 333 mounted in a hole (not shown) extended from the hexagonal box 32, and a stop member 332 supported on the spring 333 and engaged with the ratchet wheel 331 to control the direction of rotation of the ratchet wheel 331 in the hexagonal box 32.

Figure 7:
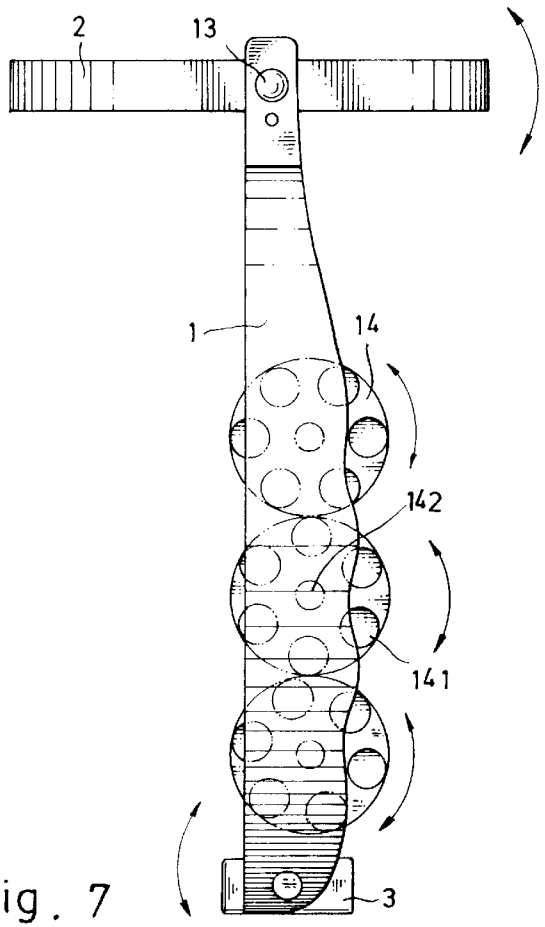
FIG. 7 is a side view of the combination tool kit of FIG. 6, showing the combination wrench, the hexagonal spanner block and the cylinders of the hexagon head socket holder respectively turned relative to the casing according to the present invention.
Figure 6:
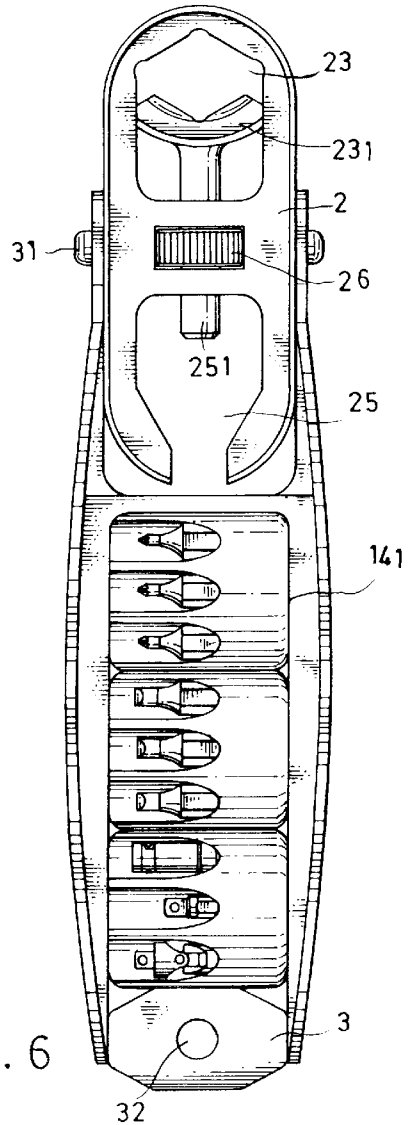
FIG. 6 is a top view of an alternate form of the combination tool kit according to the present invention.

The hexagon head socket holder 14 can have any of a variety of forms. In the embodiment shown in FIGS. from 1 through 4, the hexagon head socket holder 14 is a flat member having a plurality of receiving grooves 141 at the top and bottom sidewalls for holding a set of hexagon head sockets 4. In the embodiment shown in FIGS. 6 and 7, the hexagon head socket holder 14 is comprised of a plurality of cylinders shaped like the cylinder of a revolver (handgun) and respectively turned about a respective central pivot shaft 142 in the intermediate open chamber of the casing 1.

Figure 9:
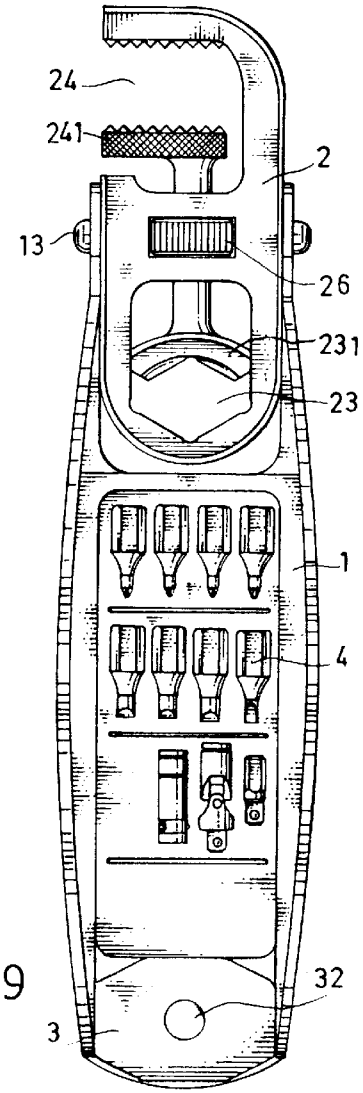
FIG. 9 is a top view of still another alternate form of the combination tool kit according to the present invention.
Figure 8:
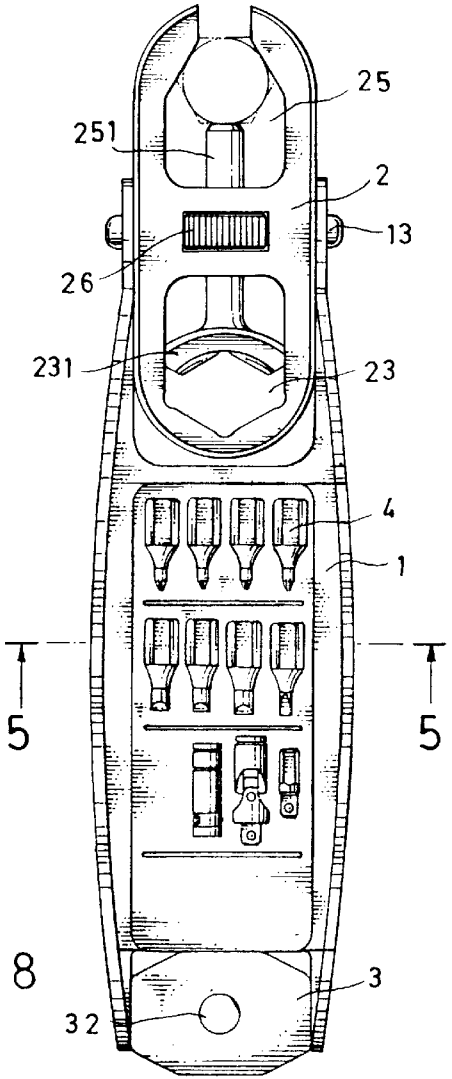
FIG. 8 is a top view of another alternate form of the combination tool kit according to the present invention.

Referring to FIGS. 8 and 9, the combination wrench 2 is comprised of a first adjustable spanner 23 at one end, and a second adjustable spanner 24 (see FIG. 9) or 25 (see FIG. 8) at an opposite end. The first adjustable spanner 23 comprises a substantially Y-shaped movable jaw 231. The second adjustable spanner 25 of the embodiment shown in FIG. 8 comprises a cylindrical sliding jaw 251. The second adjustable spanner 24 of the embodiment shown in FIG. 9 comprises a flat, toothed movable jaw 241. The Y-shaped movable jaw 231 and the flat, toothed movable jaw 241, cylindrical sliding jaw 251 are adjusted by a common adjustment screw 26.

Figure 10:
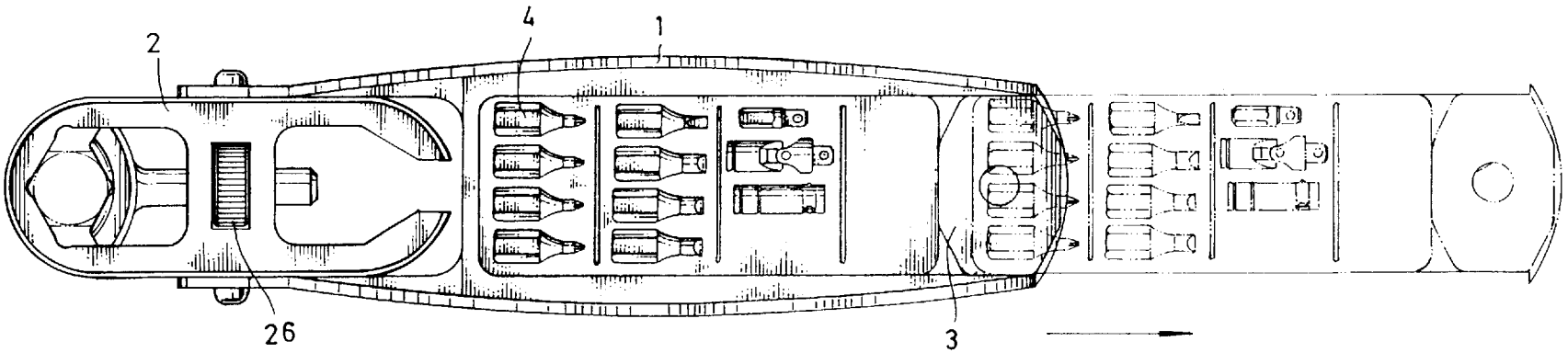
FIG. 10 is a top view of still another alternate form of the combination tool kit according to the present invention, showing the hexagon head socket holder and the hexagonal spanner block moved in and out one end of the casing.

FIG. 10 shows still another alternate form of the present invention. According to this alternate form, the hexagon head socket holder 4 and the hexagonal spanner block 3 are connected in series and longitudinally slidably mounted in a longitudinally extended track in the casing 1, so that the hexagon head socket holder 4 and the hexagonal spanner block 3 can be extended out of one end of the casing 1 or received inside the casing 1.

Figure 12:
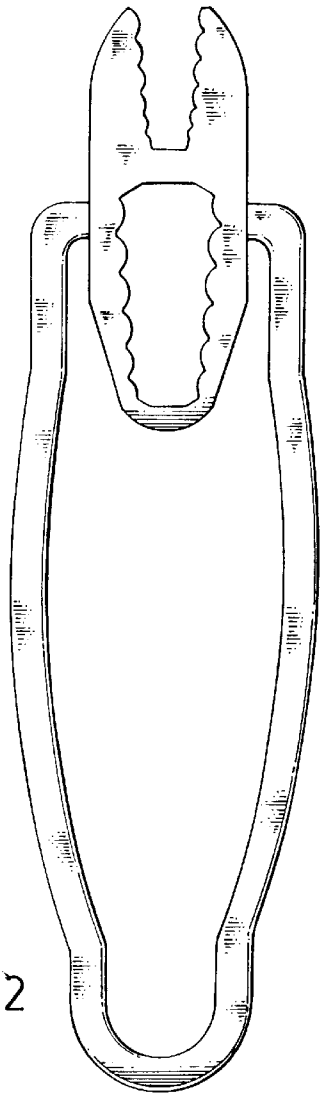
FIG. 12 is a top view of still another alternate form of the combination tool kit according to the present invention.
Figure 11:
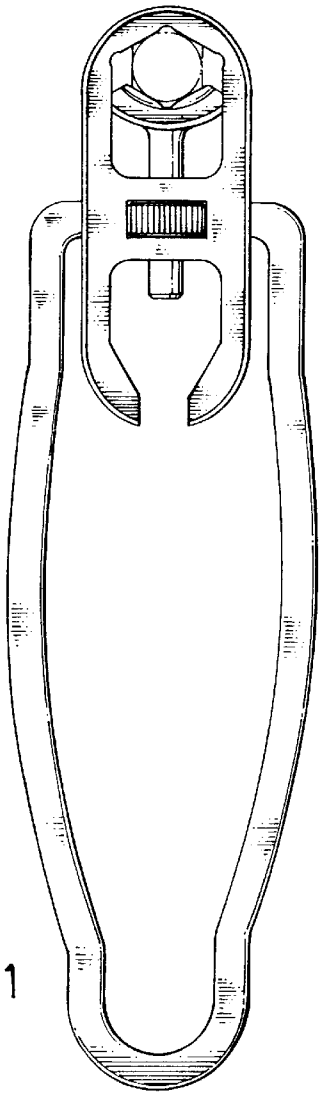
FIG. 11 is a top view of still another alternate form of the combination tool kit according to the present invention.

FIGS. 11 and 12 show still another two alternate forms of the present invention. According to these two alternate forms, the combination tool kit is comprised of a casing made of an open frame and adapted for use as a handle, and a combination wrench pivoted to one end of the casing.

It is to be understood that the drawings are designed for purposes of illustration only, and are not intended for use as a definition of the limits and scope of the invention disclosed.

What is claimed is:

1. A combination tool kit comprising:

an elongated casing, said casing comprising a front opening, a rear opening, and a hexagon head socket holder disposed in the middle between said front opening and said rear opening, said hexagon head socket holder comprising a plurality of receiving grooves, which hold a set of hexagon head sockets adapted for turning bolts and nuts;

a combination wrench pivoted to the front opening of said casing, said combination wrench comprising an open end and a box end at two distal ends thereof said open end comprising two tooted jaws facing each other for grasping and turning bolts and nuts, said box end defining an egg-like box having points for grasping and turning bolts and nuts of different sizes; and a hexagonal spanner block pivoted to the rear opening of said casing, said hexagonal spanner block having a hexagonal box adapted to work with one of the hexagon head sockets stored in said hexagon head socket holder for turning bolts and nuts.

2. The combination tool kit of claim 1 wherein said combination wrench comprises a substantially Y-shaped movable jaw installed in said box end, and an adjustable nut adapted to move said Y-shaped movable jaw back and forth in said box end at one end.

3. The combination tool kit of claim 1 wherein said combination wrench comprises a sliding jaw installed in said open end, and an adjustment nut adapted to move said sliding jaw back and forth in said open end.

4. The combination tool kit of claim 1 wherein said hexagon head socket holder is comprised of a plurality of cylinders respectively turned about a respective central pivot shaft in said casing, said cylinders each having a plurality of grooves adapted to hold said hexagon head sockets.

5.The combination tool kit of claim 1 wherein said hexagonal spanner block comprises an one-way ratchet, which enables said hexagonal spanner block to work with said casing as a reversible ratchet socket wrench, said one-way ratchet assembly comprising a ratchet wheel mounted in said hexagonal box, a spring mounted in a hole extended from said hexagonal box, and a stop member supported on said spring and engaged with said ratchet wheel to control the direction of rotation of said ratchet wheel in said hexagonal box.

* * * * *